US006536171B1

(12) United States Patent
Vandewater

(10) Patent No.: US 6,536,171 B1
(45) Date of Patent: Mar. 25, 2003

(54) ELEVATED BATTEN SYSTEM

(75) Inventor: Gerald C. Vandewater, Thousand Oaks, CA (US)

(73) Assignee: MonierLifetile, Inc., Irvine, CA (US)

( * ) Notice: Subject to any disclaimer, the term of this patent is extended or adjusted under 35 U.S.C. 154(b) by 0 days.

(21) Appl. No.: 09/653,116

(22) Filed: Aug. 31, 2000

Related U.S. Application Data

(60) Provisional application No. 60/151,642, filed on Aug. 31, 1999.

(51) Int. Cl.[7] ..... E04D 1/00; E04D 13/00; E04D 12/00

(52) U.S. Cl. ..... 52/302.1; 52/478; 52/551; 52/480; 52/733.2; 52/747.1

(58) Field of Search ..... 52/385, 384, 553, 52/551, 475.1, 781.3, 483.1, 482, 479, 390, 391, 392, 746.1, 746.11, 403.1, 506.05, 302.1, 478, 480, 747.1, 537, 733.2, 409

(56) References Cited

U.S. PATENT DOCUMENTS

| | | | | | |
|---|---|---|---|---|---|
| 4,007,571 | A | * | 2/1977 | Marchello et al. | 52/483 |
| 4,170,859 | A | * | 10/1979 | Counihan | 52/763 |
| 4,233,793 | A | * | 11/1980 | Omholt | 52/390 |
| 5,412,917 | A | * | 5/1995 | Shelton | 52/403.1 |
| 5,425,908 | A | * | 6/1995 | Merser | 264/46.4 |
| 6,189,274 | B1 | * | 2/2001 | Ollikainen | 52/264 |
| 6,266,937 | B1 | * | 7/2001 | Watanabe | 52/489.2 |

* cited by examiner

*Primary Examiner*—Robert Canfield
(74) *Attorney, Agent, or Firm*—Alston & Bird LLP

(57) ABSTRACT

An elevated batten system according to the present is designed to eliminate the need to install the vertical and horizontal battens in separate steps. By attaching pads or blocks to the underside of the horizontal battens during assembly, the function of the vertical strips is contained in the resulting batten assembly itself.

10 Claims, 5 Drawing Sheets

ELEVATED BATTEN SYSTEM (EBS)

ELEVATED BATTEN SYSTEM

CROSS-REFERENCE TO RELATED APPLICATIONS

This application claims the benefit of provisional patent application number 60/151,642, filed Aug. 31, 1999, and incorporates said application by reference.

FIELD OF THE INVENTION

The present invention relates generally to roofing, and particularly relates to a system for installing tile roofing.

BACKGROUND OF THE INVENTION

Tile roofing has been around for thousands of years continues to be the most common roofing material used throughout the world. Since tile installations predate the introduction of plywood by centuries, it is noteworthy that, except in America where tile is a relative newcomer, most tile roofs are installed on open spaced sheathing. Most commonly, the tiles are attached to 2"×2" battens that are spaced in accordance with the size of the tile. In some cases a draped underlayment or sarking system may be installed over the rafters prior to batten installation but often times the tiles themselves are that stand-alone roof system.

This method of installation has worked well for hundreds of years due to the fact that the roofs are installed in such a manner that the water is prevented from entering through the tile assembly. By sealing all hips, ridges, and walls with proper flashing materials and directing water off the roof, tile roofs provide trouble free service for decades.

Since most of the roofs in America are installed over solid roof sheathing, tile installations have been modified to suit the culture. While tile roofs installed over solid decking can be made to work, this application creates a number of problems that do not occur with tile roofs over spaced sheathing. One method of tile application that works well over solid roof decks and provides the advantages of old world installations is the counterbatten system.

Counterbatten systems are created by installing wood strips in vertical direction up the roof on 16 or 24 inches on center and then fastening the horizontal or anchor battens directly through these vertical battens. The size of these batten strips will vary according to spacing and load factors but the minimum dimensions are typically ⅜ inch thick for the vertical strips and nominal 1 by 3 inch for the horizontals. Nominal 1 by 2 inch battens are usually avoided for these applications and should never by used if the vertical strips are spaced greater than 16 inches on center.

Counterbatten or strapping systems provide an effective, long lasting method of roof tile installation. Elevating the anchor battens and tiles above the roof surface optimizes most aspects of the tile roof installation. Any concern about wind-driven rain is diminished because any water beneath the tile can course off the roof without encountering resistance from battens or tile. By preventing water ponding, all components of the system can be expected to last longer and perform better. Nail penetrations are minimized and those nails that do not penetrate the underlayment are less likely to ever by exposed to water since they only penetrate the vertical strips that run parallel to water flow.

This method has long been the standard for low slope installations and tile installations in regions subject to severe winter weather but provide significant advantage to tile installations universally.

The air space between the roof deck and the installed tile forms a highly effective thermal barrier that ventilates and cools in hot climates and helps prevent ice dams in cold regions. The strapping system optimizes this effect in both cases. In recent thermal studies performed by the Florida Department of Energy, it was shown that a typical tile roof installation reduces ceiling level heat flux by 38% compared to the same roof with a black asphalt shingle. With the counterbatten system that figure jumps to 48% reduction.

In cold weather regions, a major cause of ice damming is the heat lost through the roof that melts snow on the surface that runs down and freezes when it reaches the eaves. With the counterbatten system under the tile roof, even if attic ventilation is ineffective, the air space beneath the tile is usually sufficient to dissipate the heat before it is able to melt the snow.

Attention should be paid to flashing and edge treatments since the thickness of the vertical batten must be considered to maintain an even plane and proper flow pattern. Additional nailer boards and edge metals will usually be required at rake edges. For full details on counterbatten installations, please refer to the WSRCA/NTRMA Design Criteria Manual for Cold and Snow Regions.

Although such counterbatten systems include advantages, disadvantages still exist, and there is always room for improvement.

SUMMARY OF THE INVENTION

The present invention overcomes deficiencies in the prior art by providing an improved batten system which includes an improved installation technique as well as improved operating characteristics due to the provision of a preassembled batten assembly.

Generally described, the present invention provides an elevated batten assembly for use atop a roof supporting surface and for supporting tiles above the roof supporting surface, the elevated batten assembly comprising an elongate horizontal batten strip having an underside for generally facing the roof supporting surface, and a plurality of support pads spaced apart and attached to the underside of the batten strip, the support pads configured to be located between the batten strip and the supporting roof surface, and also configured to contact the roof supporting surface and to support the batten strip above the roof supporting surface.

Therefore it is an object of the present invention to provide an improved roofing system.

It is a further object of the present invention to provide an improved roofing system which is easy to install.

It is a further object of the present invention to provide an improved roofing system which is easy to manufacture.

It is a further object of the present invention to provide an improved roofing system which is reliable in operation.

It is a further object of the present invention to provide an improved roofing system which is easy to transport prior to installation.

Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

FIG. 2A is a lower plan view of the elevated batten assembly 10 according to the present invention, which includes a length of lumber 12 and a plurality of plywood pads 14 attached to the underside of the length of lumber 12. FIG. 2B shows the flow of water 13 (shown by the use of two lines 13) around and exemplary pad. Options #1 and #2 show slightly different pad locations, with no functional differences claimed or known.

DETAILED DESCRIPTION OF THE INVENTION

Figure 1:
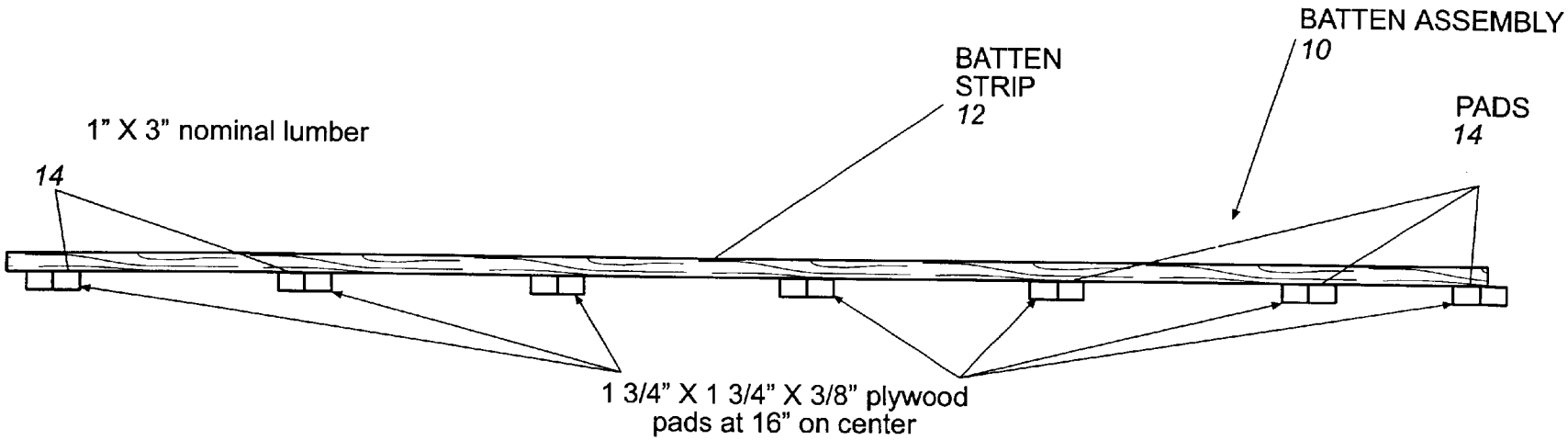
FIG. 1 is a side elevational view of an elevated batten assembly 10 according to the present invention, which includes a length of lumber 12 and a plurality of discrete, spaced apart, plywood pads 14 attached to the underside of the length of lumber 12.

The elevated batten system according to the present invention is a one-step version compared to the prior art systems described above. The prior art method of installing a counterbatten system requires that the roofer start by attaching the vertical strips (typically ⅜ inch lath) at 12-inch to 24-inch on center depending on the size of the horizontal batten to be used. Once the vertical strips are in place, the prior art horizontal battens are then attached to the vertical strips at increments determined by the tile coursing layout, usually at 13 to 14 inch spacing. The tiles are attached to the batten strips in a conventional manner.

The elevated batten system according to the present invention is designed to eliminate the need to install the vertical and horizontal battens in separate steps. By pre-attaching ⅜ inch thick blocks 14 to the underside of the horizontal battens 12 at the lumber mill or other assembly facility, the function of the vertical strips is contained in the resulting batten assembly 10 itself. The 2-inch square blocks 14 made from ⅜ inch plywood are attached at 16-inch increments to the 1-inch by 3-inch battens 12 with stapling, glue, or other suitable means prior to bundling at the production source. The elevated batten system according to the present invention may then be installed similarly to normal batten installation but will provide additional advantages.

The elevated batten system according to the present invention includes various features and benefits. The horizontal battens 14 are made of 1"×3" nominal lumber in standard lengths of 8 feet (2.44 m). Lengths other than standard (8 feet lengths) may be special ordered. However the standard 1"×2" batten that represents the current standard can also be used. It is a universal piece that can be used with any profile of tile and in a variety of load conditions. The battens can be untreated or can be treated with pressure treating or other weather resistant properties as desired.

1"×3" lumber is generally straighter and less apt to warp than 1"×2". This makes it more practical to consider aligning the battens with coursing marks rather than having to chalk lines for guidance.

The plywood blocks 14 (a.k.a. "pads"), which in one embodiment measure 1 ¾" ×1 ¾"×3/8", are attached by mechanical attachment (e.g., stapling, screws or nails), adhesion (e.g., glue), or other suitable means to one side of the horizontal batten 14 at selected distances on center (e.g., 12 inches on center, 16 inches on center, 24 inches on center, or other selected distances on center). The thickness of the pads serve to elevate the batten above the roof deck and provide adequate support to prevent deflection. The elevation of the battens 12 allows for water to pass freely beneath the batten. This prevents damming that can typically result in roof leaks or premature deterioration of the felt, batten and fasteners. These pads can be subjected to moisture treatment as desired prior to attachment.

Figure 2A:
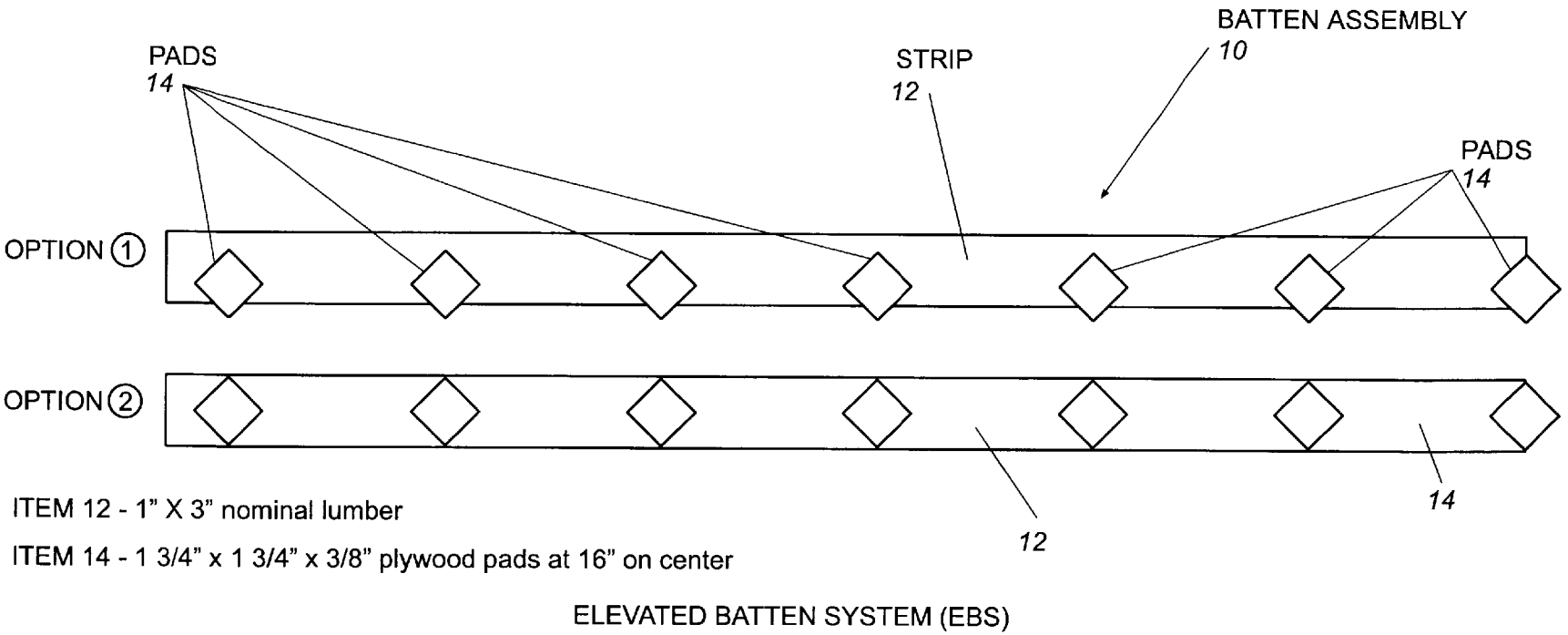
FIGS. 2A and 2B are related.
Figure 2B:
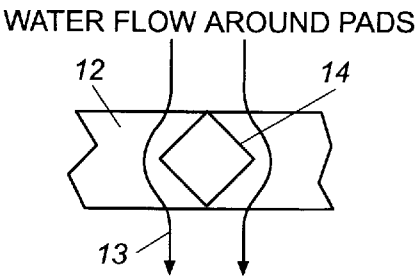
Figure 3:
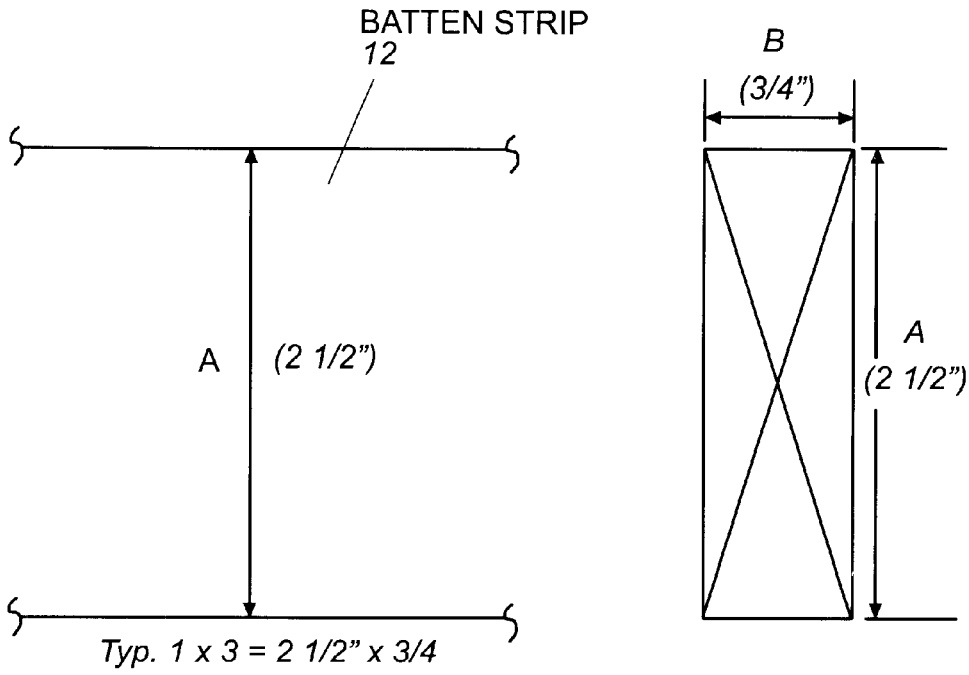
FIG. 3 is an illustrative view showing one set of dimensions of the length of lumber 12, namely dimension A which is two and one-half inches, and dimension B which is three-quarters inches.
Figure 4:
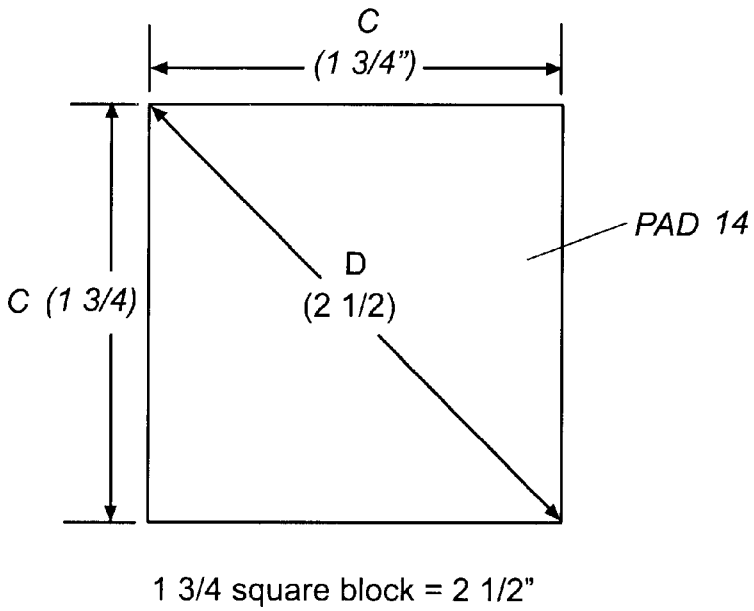
FIG. 4 is an illustrative view showing one set of dimensions of plywood pads 14, namely dimension C which is one and one-half inches, and dimension D which is two and one-half inches.
Figure 5:
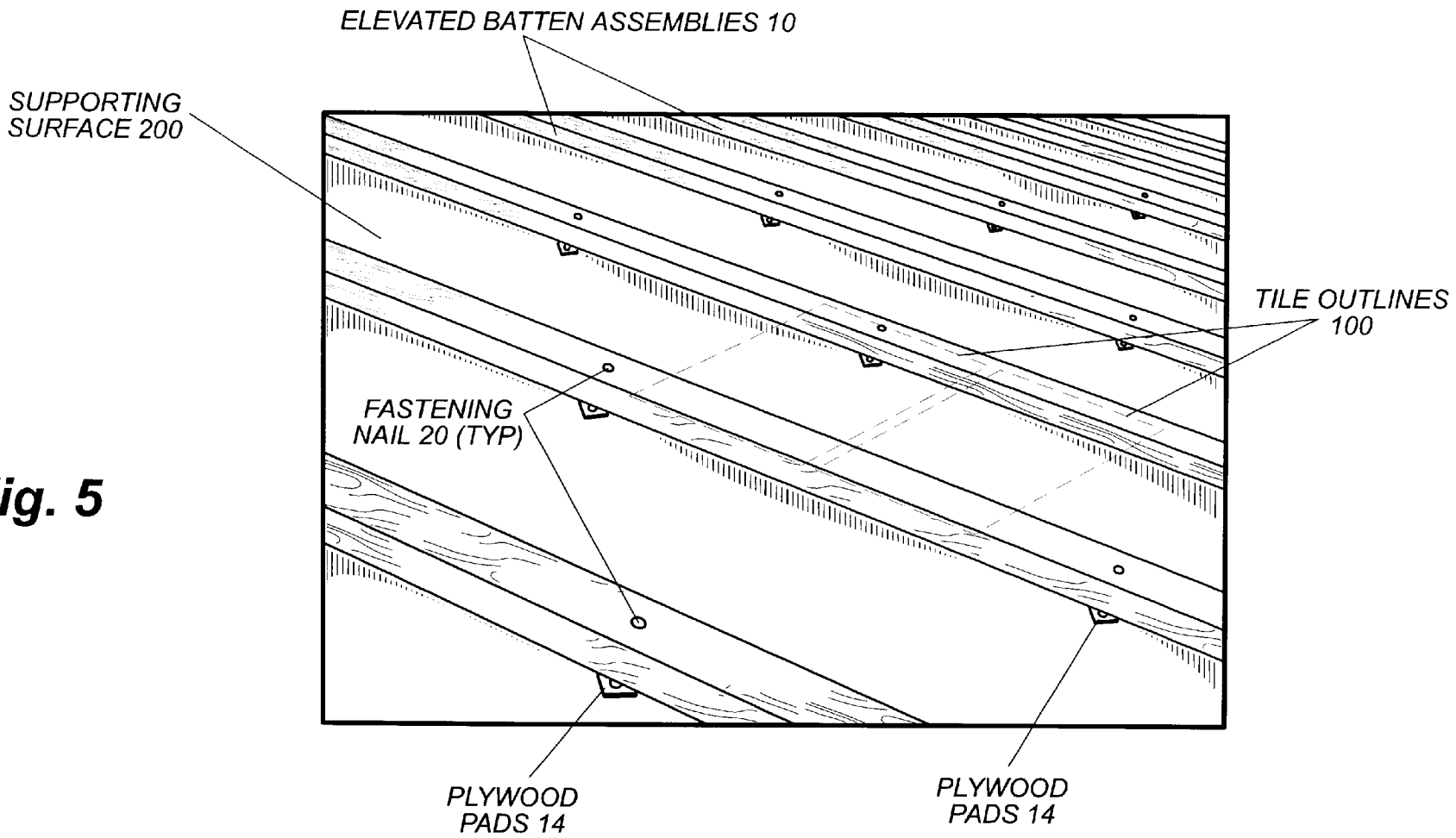
FIG. 5 is a pictorial view showing the outline of an exemplary group of tiles 100 as they would be installed atop the installed batten assemblies 10, shown installed atop an exemplary roof surface 200 by use of typical fastening nails 20.
Figure 6:
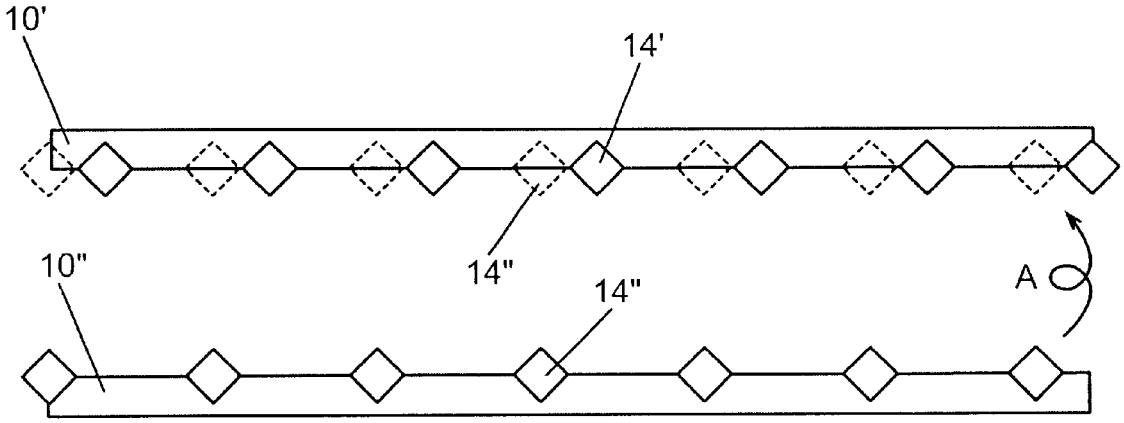
FIG. 6 shows two substantially similar batten assemblies 10', 10", such as Option 1 in FIG. 2A, which illustrates how the ends of the assembles can be reversed relative to each other, and then one assembly 10" can be flipped over (see arrow "A"), such that the two batten assemblies have their respective block sides cofacing, with the blocks 14', 14" nesting between each other in an alternating fashion.

The blocks 14 are aligned onto the batten in a diagonal direction as shown in FIG. 2B to minimize water resistance. The blocks can also be 1 inch square or other dimensions as desired, and can be made from a variety of suitable materials, including wood, rubber, plastic, or recycled material.

Alignment of the support blocks 14 is such that each end represents a "male" or "female" configuration, which allows for solid support at each end of adjoining battens, and at the same time allows for improved stacking as a male-female pair may be stacked with their respective block sides cofacing, with the blocks nesting between each other in an alternating fashion. The batten assemblies 10 can be aligned and bundled with plastic strapping, 12 battens per bundle which provides fastening for approximately one square (100 sq. ft.) of roofing tile.

CONCLUSION

Therefore it may be seen that the present invention overcomes deficiencies in the prior art by providing an improved batten assembly which includes improved performance, reduces assembly time of the battens at the construction site, and allows for adjustability of the system to meet particular site installation needs.

While this invention has been described in specific detail with reference to the disclosed embodiments, it will be understood that many variations and modifications may be effected within the spirit and scope of the invention as described in the appended claims.

That which is claimed:

1. An elevated batten assembly for use atop an inclined roof supporting surface and for supporting tiles above said inclined roof supporting surface, said elevated batten assembly comprising:

an elongate horizontal batten strip having an underside for generally facing said inclined roof supporting surface; and a plurality of support pads spaced apart and attached to the underside of the said batten strip, said support pads being substantially flat, including opposing first and second flat sides, said support pads configured to be located between said batten strip and said inclined roof supporting surface such that said first flat side of each said support pad is in planar contact with said underside of said elongate horizontal batten strip, and each support pad is also configured to contact said inclined roof supporting surface such that said second flat side is in planar contact with said roof supporting surface and such that said support pads combine to support said batten strip above said inclined roof supporting surface, wherein said support pads have a nominal thickness and a rectangular outline, and such that said pads are installed such that one of their corners is oriented in a direction up the slope of said roof support surface, for purposes of water drainage under said batten strips and past said rectangular support pads.

2. The elevated batten assembly as claimed in claim 1, wherein said support pads have a nominal thickness and a square outline, and such that said pads are installed such that one of their comers is oriented in a direction up the slope of said roof supporting surface, for purposes of water drainage under said batten strips and past said rectangular support pads.

3. The elevated batten assembly as claimed in claim 1, wherein said support pads are attached to said batten strip by mechanical means.

4. The elevated batten assembly as claimed in claim 1, wherein said support pads are attached to said batten strip by adhesive.

5. An elevated batten assembly for use atop a roof supporting surface and for supporting tiles above said roof supporting surface, said elevated batten assembly comprising:

an elongate horizontal batten strip having an underside for generally facing said roof supporting surface; and a plurality of support pads spaced apart and attached to the underside of said batten strip, said support pads configured to be located between said batten strip and said roof supporting surface, and also configured to contact said roof supporting surface and to support said batten strip above said roof supporting surface, said support pads also attached along the length of said batten strip in a nonsymmetrical manner to allow a pair of them, prior to being installed, to nest together with said batten strip undersides facing each other and said batten strip ends being inverted relative to each other, wherein said support pads have a nominal thickness and a rectangular outline, and such that said pads are installed such that one of their corners is oriented in a direction up the slope of said roof supporting surface, for purposes of water drainage under said batten strips and past said rectangular support pads.

6. The elevated batten assembly as claimed in claim 5, wherein said support pads have a nominal thickness and a square outline, and such that said pads are installed such that one of their corners is oriented in a direction up the slope of said roof supporting surface, for purposes of water drainage under said batten strips and past said square support pads.

7. The elevated batten assembly as claimed in claim 5, wherein said support pads are attached to said batten strip by mechanical means.

8. The elevated batten assembly as claimed in claim 5, wherein said support pads are attached to said batten strip by adhesive.

9. An elevated batten assembly for use atop an inclined planar roof supporting surface which may occasionally have water running down said surface, said elevated batten assembly configured for supporting tiles above said inclined roof supporting surface, said elevated batten assembly comprising:

an elongate horizontal batten strip having a planar underside configured for generally facing said planar roof supporting surface when installed; and a plurality of spaced apart support pads each positioned between said batten strip and said inclined roof supporting surface, said support pads combining to support said batten strip above said inclined roof supporting surface, at least one of said support pads defining a corner oriented such that it points up the slope of the roof, thus diverting the flow of said water to either side of said comer, thus improving water drainage.

10. A method of installing roof tiles atop an existing inclined roof supporting surface, said method comprising the steps of:

a) assembling a plurality of elongate batten assemblies, each batten assembly itself comprising an elongate batten strip and a plurality of support pads attached thereto, each of said support pads having a nominal thickness and a rectangular outline defining at least one corner, said elongate batten strip having opposing first and second primary planar sides, said support pads associated with each batten strip being substantially flat, including opposing first and second flat sides, and configured for being attached to the same first side of their associated batten strip such that said first flat side of each of said support pads is in planar contact with said first side of said associated elongate horizontal batten strip and such that at least one of said support pads is configured to be installed such that said one comer is oriented in a direction up the slope of said roof supporting surface, for purposes of water drainage under said batten strips and past said rectangular support pads;

b) installing said batten assemblies atop said roof supporting surface such that said second flat sides of said support pads of said elongate batten assemblies are facing said inclined roof surface and said second side of each of said elongate batten strips is inclined and facing away from said roof surface, and such that said batten strips are spaced apart from said roof surface by said support pads, and said opposing first and second flat sides of said support pads are inclined, and said at least one corner is oriented in direction up the slope of the roof supporting surface, for purposes of water drainage under said batten strips and past said rectangular support pads on either side of said corner; and c) installing tiles atop said inclined second sides of said batten assemblies.

* * * * *

UNITED STATES PATENT AND TRADEMARK OFFICE

CERTIFICATE OF CORRECTION

PATENT NO. : 6,536,171 B1
DATED : March 25, 2003
INVENTOR(S) : Vandewater

It is certified that error appears in the above-identified patent and that said Letters Patent is hereby corrected as shown below:

Title page,
Item [56], References Cited, U.S. PATENT DOCUMENTS, insert the following:

| | | |
|---|---|---|
| -- 1,163,034 | 12/1915 | Phippen |
| 2,862,255 | 12/1958 | Nelson |
| 3,253,375 | 5/1966 | Takehara |
| 4,958,471 | 9/1990 | Waddington |
| 5,471,807 | 12/1995 | Vasquez |
| 5,642,596 | 7/1997 | Waddington |
| 6,357,193 | 3/2002 | Morris --. |

Column 5,
Line 13, “comers” should read -- corners --.

Column 6,
Lines 18 and 38, “comer” should read -- corner --.

Signed and Sealed this

Ninth Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,536,171 B1
DATED : March 25, 2003
INVENTOR(S) : Vandewater

It is certified that error appears in the above-identified patent and that said Letters Patent is hereby corrected as shown below:

Title page,
Item [56], References Cited, U.S. PATENT DOCUMENTS, insert the following:

| | | |
|---|---|---|
| -- 1,163,034 | 12/1915 | Phippen |
| 2,862,255 | 12/1958 | Nelson |
| 3,253,375 | 5/1966 | Takehara |
| 4,958,471 | 9/1990 | Waddington |
| 5,471,807 | 12/1995 | Vasquez |
| 5,642,596 | 7/1997 | Waddington |
| 6,357,193 | 3/2002 | Morris --. |

Column 5,
Line 13, “comers” should read -- corners --.

Column 6,
Lines 18 and 38, “comer” should read -- corner --;

Signed and Sealed this

Sixteenth Day of September, 2003

JAMES E. ROGAN
*Director of the United States Patent and Trademark Office*